US012662300B2

(12) United States Patent
Stevens

(10) Patent No.: US 12,662,300 B2
(45) Date of Patent: Jun. 23, 2026

(54) DRINKING VESSEL

(71) Applicant: Louisa Rebecca Stevens, Leeds (GB)

(72) Inventor: Louisa Rebecca Stevens, Leeds (GB)

( * ) Notice: Subject to any disclaimer, the term of this patent is extended or adjusted under 35 U.S.C. 154(b) by 399 days.

(21) Appl. No.: 18/563,191

(22) PCT Filed: May 25, 2022

(86) PCT No.: PCT/GB2022/051313
§ 371 (c)(1),
(2) Date: Nov. 21, 2023

(87) PCT Pub. No.: WO2022/248854
PCT Pub. Date: Dec. 1, 2022

(65) Prior Publication Data

US 2024/0239589 A1 Jul. 18, 2024

(30) Foreign Application Priority Data

May 26, 2021 (GB) ..... 2107456

(51) Int. Cl.
*B65D 81/38* (2006.01)

(52) U.S. Cl.
CPC ..... *B65D 81/3869* (2013.01); *B65D 2543/00092* (2013.01)

(58) Field of Classification Search
CPC ..... B65D 81/3869; B65D 2543/00092; B65D 81/3872; B65D 81/3844; B65D 81/3846;
(Continued)

(56) References Cited

U.S. PATENT DOCUMENTS 2,805,556 A 9/1957 Wang
4,782,670 A * 11/1988 Long ..... F25D 3/08 62/530

(Continued)

FOREIGN PATENT DOCUMENTS

CN 1084724 A 4/1994
CN 107510327 A 12/2017

(Continued)

OTHER PUBLICATIONS

Combined Search and Examination Report under Sections 17 and 18(3) in GB2107456.2 dated Oct. 25, 2021 (9 pages).

(Continued)

*Primary Examiner* — Nathan J Jenness
*Assistant Examiner* — John Martin Hoppmann
(74) *Attorney, Agent, or Firm* — Foley & Lardner LLP

(57) ABSTRACT

A drinking vessel (100) having a drink chamber (D) with an opening for receiving a drinking liquid, wherein the drink chamber is defined by a drink chamber wall (110), wherein the drinking vessel has an inner liquid filled chamber (120) for receiving heat from a drinking liquid in the drink chamber through the drink chamber wall, the drinking vessel has an intermediary thermally insulating layer (140) and an outer liquid filled chamber (130) that is thermally insulated from the inner liquid filled chamber by the intermediary thermally insulating layer, the drinking vessel has an upper channel (141) and a lower channel (142) for providing fluid communication through the intermediary thermally insulating layer between the inner liquid filled chamber and the outer liquid filled chamber, and the drinking vessel has a user operable valve (150) for opening and closing at least one of the upper channel and lower channel for controlling circulation of liquid between the inner liquid filled chamber and the outer liquid filled chamber by a convection current.

18 Claims, 8 Drawing Sheets

(58) Field of Classification Search
CPC .... A47J 41/0044; A47J 36/2416; A47J 31/50; A47J 41/022; A47G 19/2288; A47G 19/127; A47G 19/2205; F25D 1/02; Y02E 60/14; Y10S 165/902
USPC ..... 220/501, 715, 495.03, 592.17, 592.26, 220/574.2, 62.12, 62.18; 165/163, 902; 215/13.1
See application file for complete search history.

(56) References Cited

U.S. PATENT DOCUMENTS

| | | | | |
|---|---|---|---|---|
| 6,176,100 | B1 * | 1/2001 | Kremesec | A47G 19/2288 62/530 |
| 6,471,085 | B1 | 10/2002 | Gallo | |
| 7,934,537 | B2 * | 5/2011 | Kolowich | A47J 36/2444 165/902 |
| 2021/0127890 | A1 * | 5/2021 | Baston | A47J 41/022 |

FOREIGN PATENT DOCUMENTS

| | | | | |
|---|---|---|---|---|
| CN | 108742036 | A * | 11/2018 | A47G 19/2288 |
| WO | WO-2006/103084 | A1 | 10/2006 | |

OTHER PUBLICATIONS

International Search Report and Written Opinion in PCT/GB2022/051313 dated Aug. 16, 2022 (9 pages).

* cited by examiner

DRINKING VESSEL

CROSS-REFERENCE TO RELATED APPLICATIONS

This application is a U.S. National Phase Application under 35 U.S.C. § 371 of International Application No. PCT/GB2022/051313, filed on May 25, 2022, which claims the benefit of and priority to GB Patent Application No. 2107456.2, filed on May 26, 2021, which are each incorporated herein by reference in their entireties for any and all purposes.

TECHNICAL FIELD

The present invention relates to drinking vessels, and more particularly, but not exclusively, to mugs.

BACKGROUND

Typical ceramic, glass and metal mugs have a low thermal mass, compared with the drink they contain when mostly full. When freshly poured into such drinking vessels, hot drinks are commonly too hot for a user to drink, and once the temperature of the drink has lowered to a drinkable temperature, it then soon cools to an even lower temperature, at which the drink is less palatable.

SUMMARY OF THE DISCLOSURE

According to the present disclosure, there is provided a drinking vessel in accordance with the appended claims.

According to an aspect, there is provided a drinking vessel having a drink chamber with an opening for receiving a drinking liquid, wherein the drink chamber is defined by a drink chamber wall, wherein the drinking vessel has an inner liquid filled chamber for receiving heat from a drinking liquid in the drink chamber through the drink chamber wall, the drinking vessel has an intermediary thermally insulating layer and an outer liquid filled chamber that is thermally insulated from the inner liquid filled chamber by the intermediary thermally insulating layer, the drinking vessel has an upper channel and a lower channel for providing fluid communication through the intermediary thermally insulating layer between the inner liquid filled chamber and the outer liquid filled chamber, wherein the upper channel is closer to the opening of the drink chamber than the lower channel, and the drinking vessel has a user operable valve for opening and closing at least one of the upper channel and lower channel for controlling circulation of liquid between the inner liquid filled chamber and the outer liquid filled chamber by a convection current.

The drinking vessel is reconfigurable by opening or closing of the user operable valve or user operable valves between:

a first configuration in which the user operable valve is open and liquid can circulate freely between the inner and outer liquid filled chambers, thus allowing effective transfer of heat by one or more convective loops through the thermal insulation between the inner and outer liquid filled chambers; and a second configuration in which the user operable valve is closed in which liquid cannot circulate freely between the inner and outer liquid filled chambers, thus preventing transfer of heat by a convective loop through the thermal insulation between the inner and outer liquid filled chambers.

The drinking vessel may have a base portion and a side wall (side portion), and the lower channel may be provided through the intermediary thermally insulating layer in the base portion. The lower channel may be aligned vertically when the base of the drinking vessel rests on a horizontal surface.

The drinking vessel may have a base portion and a side wall, and the upper channel may be provided through the intermediary thermally insulating layer in the side wall proximate the opening. The upper channel may be aligned horizontally when the base of the drinking vessel rests on a horizontal surface.

The total heat capacity of the inner liquid filled chamber and the outer liquid filled chamber may be at least 20% of the heat capacity of water in the drink chamber D, when the drink chamber is 80% full. The total heat capacity of the inner liquid filled chamber and the outer liquid filled chamber may be at least 30% of the heat capacity of water in the drink chamber D, when the drink chamber is 80% full. The total heat capacity of the inner liquid filled chamber and the outer liquid filled chamber may be at least 40% of the heat capacity of water in the drink chamber D, when the drink chamber is 80% full.

The volume L2 of the outer liquid filled chamber 130 may be greater than the volume L1 of the inner liquid filled chamber 120. The volume L2 of the outer liquid filled chamber 130 may be greater than the volume L1 of the inner liquid filled chamber 120 by at least 50%, e.g. by at least 100%.

The drinking vessel may comprise a plurality of inner liquid filled chambers and a plurality of outer liquid filled chambers.

The drinking vessel may comprise a first upper channel and a first lower channel that provide fluid communication through the intermediary thermally insulating layer between a first inner liquid filled chamber and the first outer liquid filled chamber, with a first valve for opening and closing at least one of the first upper channel and first lower channel, and a second upper channel and a second lower channel that provide fluid communication through the intermediary thermally insulating layer between a second inner liquid filled chamber and the second outer liquid filled chamber, with a second valve for opening and closing at least one of the second upper channel and second lower channel.

The plurality of inner liquid filled chambers may comprise inner liquid filled chambers having different volumes.

The plurality of outer liquid filled chambers may comprise outer liquid filled chambers having different volumes.

The drinking vessel may have an outer wall and an external thermally insulating layer extending between an outer liquid filled chamber and the outer wall.

The or each inner liquid filled chamber and the or each outer liquid filled chamber may contain water.

The user operable valve may be provided in the upper channel, and the upper channel may be angled away from the perpendicular to the inner wall of the drink chamber D (e.g. and the outer wall), being angled away from being perpendicular to the inner wall (410) of the drink chamber (D) by at least 30°, e.g. at least 45°.

The thermally insulating region has a side wall that may be provided with inwardly projecting ribs.

The thermally insulating region may be provided with a side wall with outwardly projecting ribs.

The thermally insulating region may have a corrugated side wall with a shape that varies around the circumference of the side wall.

The inner and outer liquid chambers may be filled with a liquid with an isobaric volumetric heat capacity of more than 1 J/(cm$^3$·K) at room temperature, for example water having an isobaric volumetric heat capacity of approximately 4.2 J/(cm$^3$·K) at room temperature.

The drinking vessel may have an outer wall provided with a plurality of thermally insulating spacers for spacing apart the hand of a user from the outer surface in use.

The drinking vessel may have an outer wall provided with a handle for spacing apart the hand of a user from the outer wall in use.

The outer liquid filled chamber may have a thickness adjacent the outer wall that is greater on the side of the drink chamber that is proximate the user operable valve than the thickness on the side of the drink chamber that is remote from the user operable valve.

The user operable valve may be accessible at a side surface of the drinking vessel. The user operable valve may be accessible at the top of the drinking vessel.

DESCRIPTION OF THE DRAWINGS

Examples are further described hereinafter with reference to the accompanying drawings, in which.

DETAILED DESCRIPTION

In the described examples, like features have been identified with like numerals, albeit in some cases having one or more of: increments of integer multiples of 100 and suffix letters. For example, in different figures, 100, 200, 300, 400, 500 and 500' have each been used to indicate a drinking vessel, and 120, 220A and 220B have been used to indicate an inner liquid filled chamber.

Figure 1A:
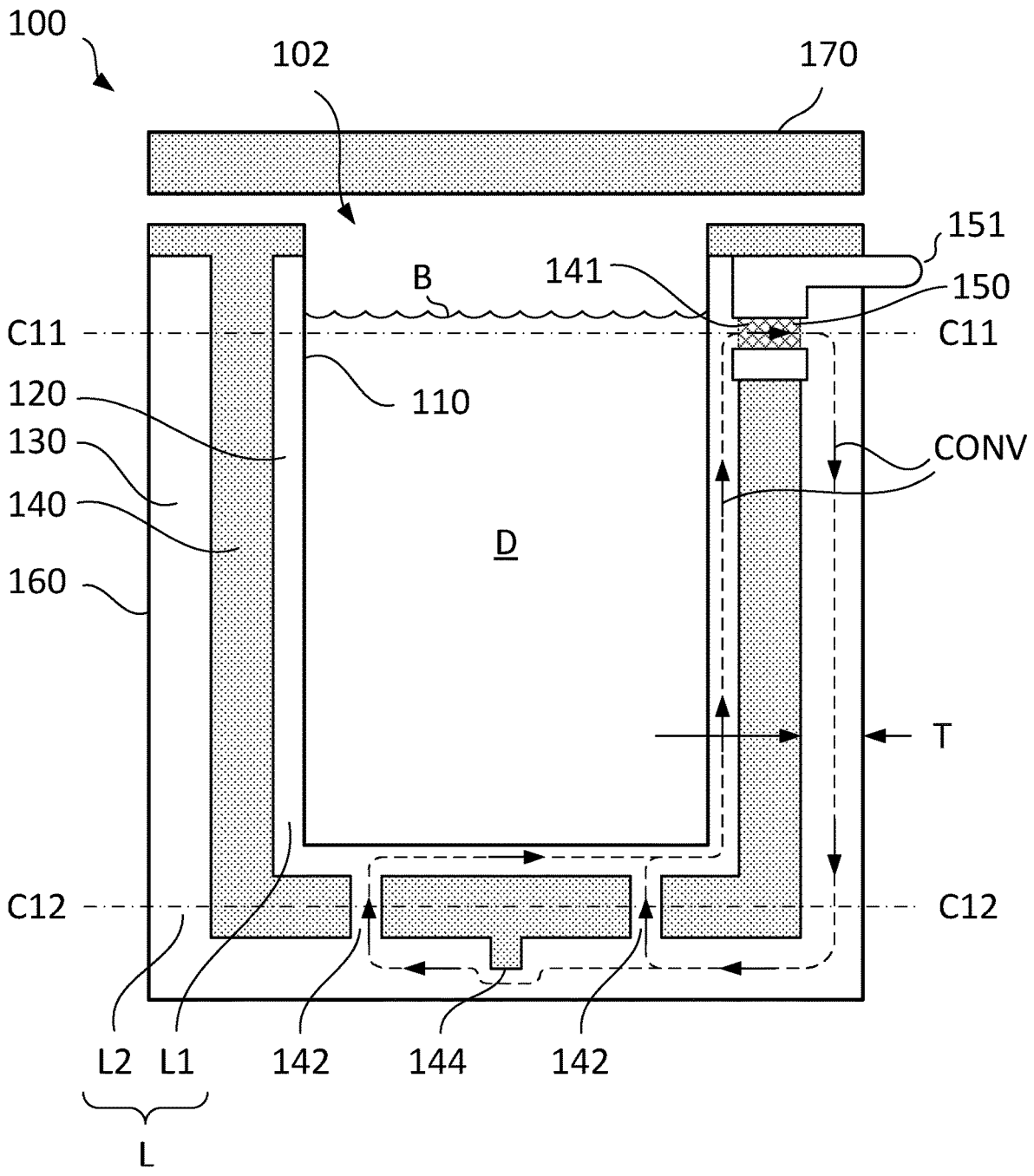
FIGS. 1A, 1B and 1C show a vertical and two horizontal sectional views of a first drinking vessel.
Figure 1B:
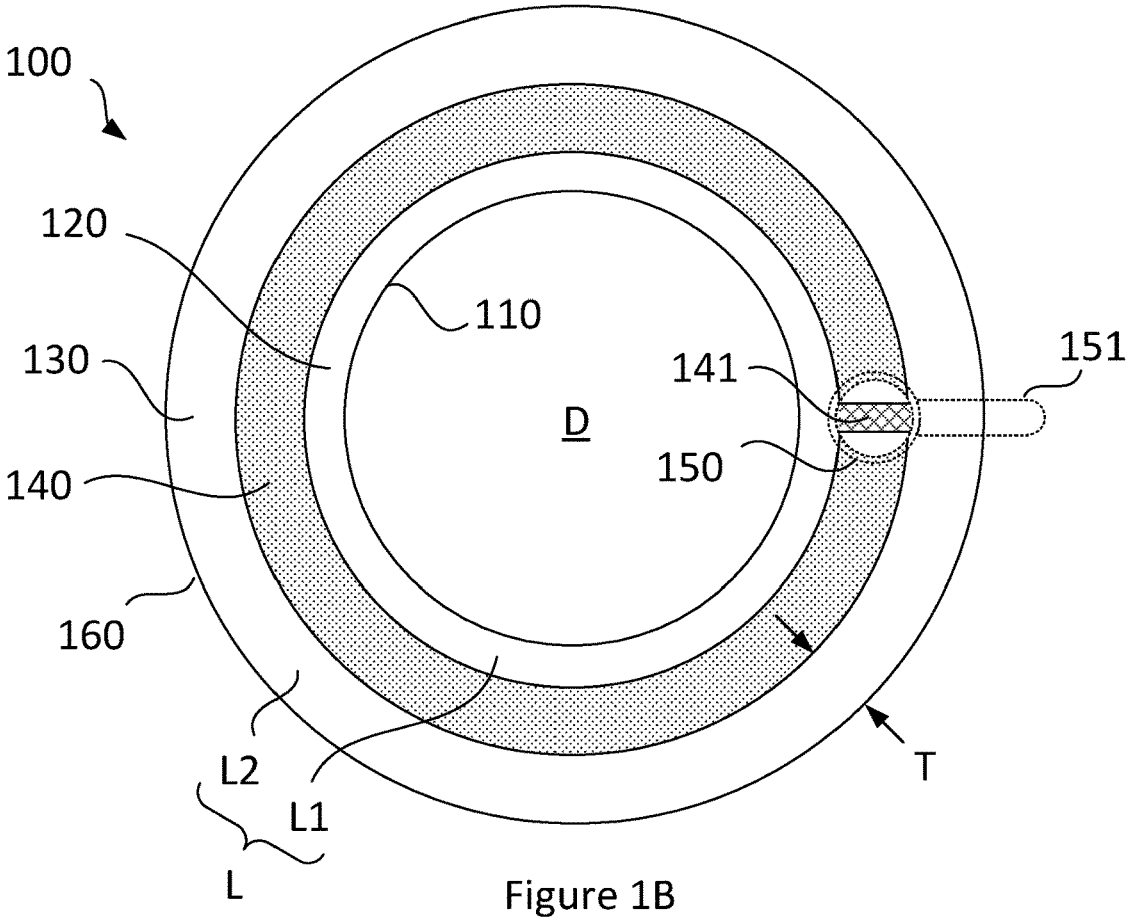

FIGS. 1A and 1B respectively show sectional views through a first drinking vessel 100 in vertical and horizontal planes (e.g. when its base is rested on a table) in which the inner surface 110 of the vessel 100 provides a drink chamber D for receiving a drinking liquid, a beverage B, in use. FIG. 1B shows horizontal cross-section C11 through the drinking vessel 100 of FIG. 1A. The drinking vessel 100 contains a liquid L for storage and convection of heat, having inner liquid L1 in an inner liquid filled chamber 120 and outer liquid L2 in an outer liquid filled chamber 130. The vessel is provided with an intermediary thermally insulated region (intermediary thermally insulating layer) 140 between the inner and outer liquid filled chambers 120, 130. The inner liquid filled chamber 120 is adjacent the drink chamber D and in good thermal communication with the beverage B (drink) in the drink chamber D in use. The outer liquid filled chamber 130 is spaced apart from the drink chamber D and is not in good thermal communication with the beverage B (drink) in the drink chamber D in use. The outer liquid filled chamber 130 is generally thermally insulated from the inner liquid filled chamber 120 by the thermally insulated region 140.

The drinking vessel 100 has an opening 102 for receiving the beverage B (drink) into the drink chamber D.

Upper channel 141 and lower channel(s) 142 are provided through the thermally insulated region 140 for allowing liquid L to flow between the inner and outer liquid chambers 120, 130. The upper channel 141 is located closer to the opening 102 than the lower channel 142 (e.g. the upper channel 141 is located near the top of the wall of the drinking vessel, when the vessel rests on its base). The upper channel 141 is provided with a user operable valve 150 (e.g. a rotating valve), and the upper channel may be opened and closed by respectively opening and closing the valve 150 to control the flow of liquid L through the upper channel (in an alternative drinking vessel, the user operable valve may open and close the or each lower channel). The user can open and close the valve 150 with a lever 151 that is accessible on the outside of drinking vessel 100 (e.g. accessible at a side surface of the drinking vessel). In the illustrated drinking vessel, a plurality of lower channels 142 are provided through the thermally insulating region 140 in the base of the drinking vessel. The different heights of the upper and lower channels 141, 142 (e.g. when the vessel is rested on its base) enable the formation of convection currents, as discussed below. The outer wall 160 of the drinking vessel 100 encloses the outer liquid filled chamber 130. The vessel 100 may be provided with a removable lid 170.

The underside of the base of the thermally insulating region 140 is provided with one or more spacers 144 to space apart the thermally insulating region from the outer wall 160, to ensure that a flow path for liquid L2 remains open. Alternatively, the outer wall may be provided one or more spacers to space apart the thermally insulating region from the outer wall. In a further alternative, the thermally insulating region may be mounted on the inner wall 110 or the outer wall 160.

The inner liquid filled chamber 120 and the outer liquid filled chamber 130 may have different volumes of liquid L1, L2. For example, the inner liquid filled chamber 120 may have a smaller volume of liquid L1 than the liquid L2 in the outer liquid filled chamber 130, so that heat transfer from the beverage B in the drink chamber D may be greatly increased by opening the valve 150 (i.e. the heat transfer to the combined liquids L1, L2 of both the inner and outer liquid filled chambers 120, 130, when the valve 150 is open, may be much greater than the heat transfer to the liquid L1 of the inner liquid filled chamber 120 alone, when the valve 150 is closed). The volume L2 of the outer liquid filled chamber 130 may be greater than the volume L1 of the inner liquid filled chamber 120 by at least 50%, e.g. by at least 100% (i.e. at least double the volume).

FIG. 1B shows a sectional view through a drinking vessel 100 in a horizontal plane (C11 in FIG. 1A) near to the top of the side wall of the drinking vessel, through the valve 150.

Figure 1C:
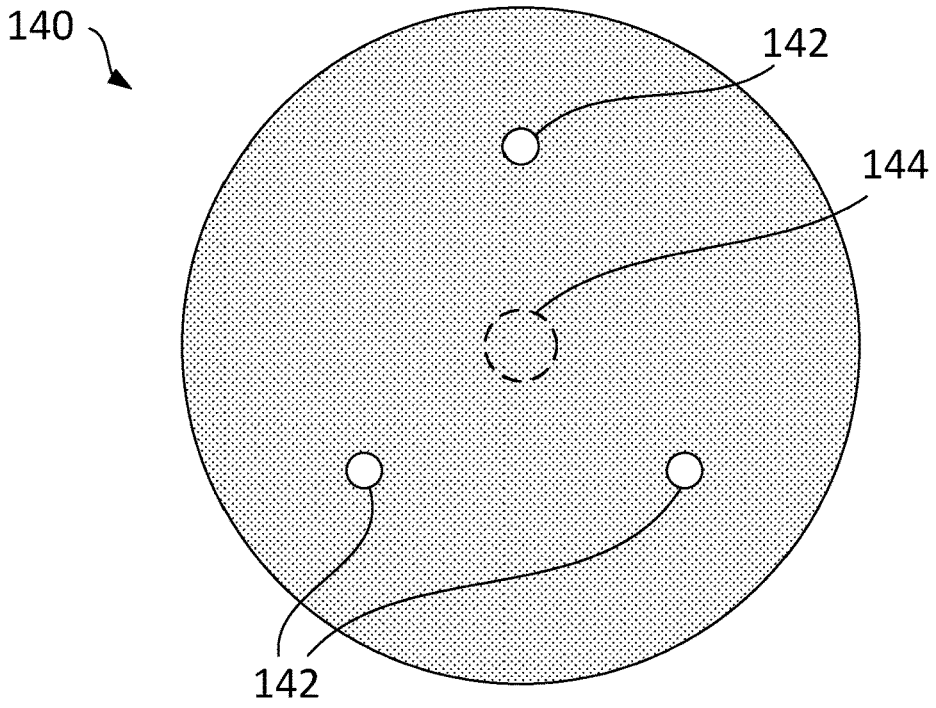

FIG. 1C shows a sectional view of the base of a thermally insulated region 140 of a drinking vessel in a further horizontal plane, extending through the intermediary thermally insulating region 140 in the base of the drinking vessel 100. FIG. 1C shows horizontal cross-section C12 through the drinking vessel 100 of FIG. 1A. As shown, a plurality of lower channels 142 may be provided through the intermediary thermally insulating region 140 in the base of the drinking vessel 100. The lower channels 142 may be vertically orientated, when the drinking vessel rests upon its base. The (or each) lower channel 142 may have a bore diameter of at least 3 mm, e.g. 5 mm.

The inner and outer surfaces of the drinking vessel 110, 160 may be formed from sheet metal (e.g. aluminium or stainless steel) or from plastic.

The thermally insulated region 140 may be bounded by a thin wall of material that provides structural rigidity, such as plastic, e.g. PET-G (polyethylene terephthalate glycol) or polycarbonate. The central part of the thermally insulated region may have one or both of a thermal conductivity of less than 0.15 W/(m·K) (e.g. less than 0.1 W/(m·K)) and an isobaric volumetric heat capacity of less than 0.5 J/(cm$^3$·K) at room temperature (e.g. less than 0.2 J/(cm$^3$·K)). For example, the central part of the thermally insulated region may comprise one or more of the following materials (e.g. within a chamber of the thermally insulated region):

- expanded polystyrene having a thermal conductivity of approximately 0.03 W/(m·K) and an isobaric volumetric heat capacity of approximately 0.03 J/(cm$^3$·K) at room temperature;
- glass wool having a thermal conductivity of approximately 0.04 W/(m·K) and an isobaric volumetric heat capacity of approximately 0.02 J/(cm$^3$·K) at room temperature;
- wool felt having a thermal conductivity of approximately 0.07 W/(m·K) and an isobaric volumetric heat capacity of approximately 0.33 J/(cm$^3$·K) at room temperature; and
- or air having a thermal conductivity of approximately 0.03 W/(m·K) and an isobaric volumetric heat capacity of approximately 0.001 J/(cm$^3$·K) at room temperature.

The regions of inner and outer surfaces of the drinking vessel in which the facing surfaces are not provided with thermal insulation (between the wall 110, 160 and liquid) may have a thermal conductivity of greater than 0.15 W/(m·K) (e.g. thermal conductivity greater than 0.5 W/(m·K), or greater than 5 W/(m·K). These regions may enable heat to couple from the beverage B to the liquid L and from the liquid L to the exterior 160 of the drinking vessel (100) much more rapidly than through the regions of thermal insulation. For example, these regions may comprise one or more of:

- aluminium or aluminium alloy, having a thermal conductivity of approximately 80 to 240 W/(m·K) and an isobaric volumetric heat capacity of approximately 2.4 J/(cm$^3$·K) at room temperature;
- steel having a thermal conductivity of approximately 15 W/(m·K) and an isobaric volumetric heat capacity of approximately 4 J/(cm$^3$·K) at room temperature;
- PET-G having a thermal conductivity of approximately 0.29 W/(m·K) and an isobaric volumetric heat capacity of approximately 1.5 J/(cm$^3$·K) at room temperature; and
- polycarbonate having a thermal conductivity of approximately 0.2 W/(m·K) and an isobaric volumetric heat capacity of approximately 1.5 J/(cm$^3$·K) at room temperature.

In use, the liquid L within the inner and outer liquid filled chambers 120, 130, for example water (having an isobaric volumetric heat capacity of approximately 4.2 J/(cm$^3$·K)), provides thermal masses with a much higher average specific heat capacity than the thermal insulation (e.g. an isobaric volumetric heat capacity that is at least ten times larger), and provides one or more bodies into which a substantial proportion of the heat of a freshly poured beverage B (drink) in the drink chamber D can be coupled. Collectively, the heat capacity of the thermal masses may be at least 5% (e.g. at least 10%, at least 15%, at least 20%, at least 30%, or at least 40%) of the heat capacity of hot water in the drink chamber D, when the drink chamber is 80% full.

In use, the drinking vessel 100 may initially be set with the valve 150 open, enabling heat from a hot beverage B to be transferred to liquid L1, L2 in both the inner and outer liquid filled chambers 120, 130. As liquid L1 in the inner liquid filled chamber 120 is warmed by the heat transferred from the hot beverage, convection currents CONV are induced in the liquid. When it is warmed, the liquid L1 in the inner liquid filled chamber rises, and flows through upper channel 141, into the upper region of the outer liquid filled chamber 130. Cooler liquid L2 from the lower region of the outer liquid filled chamber 130 flows through the lower channel(s) 142 into the inner liquid filled chamber, coming into thermal contact with the hot beverage B through the inner surface (wall) 110 of the vessel. The transfer of warmed liquid L from the inner liquid filled chamber 120 to the outer liquid filled chamber 130 enables the transfer of heat from the hot beverage B to the exterior of the drinking vessel 160, and dissipation of heat from the hot beverage to the external environment. The convection current enables an over-temperature hot beverage B (drink) to cool more rapidly to a drinkable temperature.

Once the hot beverage B has cooled to a drinkable temperature, the valve 150 may be closed, preventing transfer of heat by a convective loop of liquid L between the inner and outer liquid chambers 120, 130, to better thermally insulate the beverage, and reduce the rate at which it cools further, so maintaining the beverage at a palatable temperature for longer.

Although described in use with a hot beverage B, it will be appreciated that the drinking vessel may similarly be used to modify and control the heat of a chilled beverage.

Figure 1D:
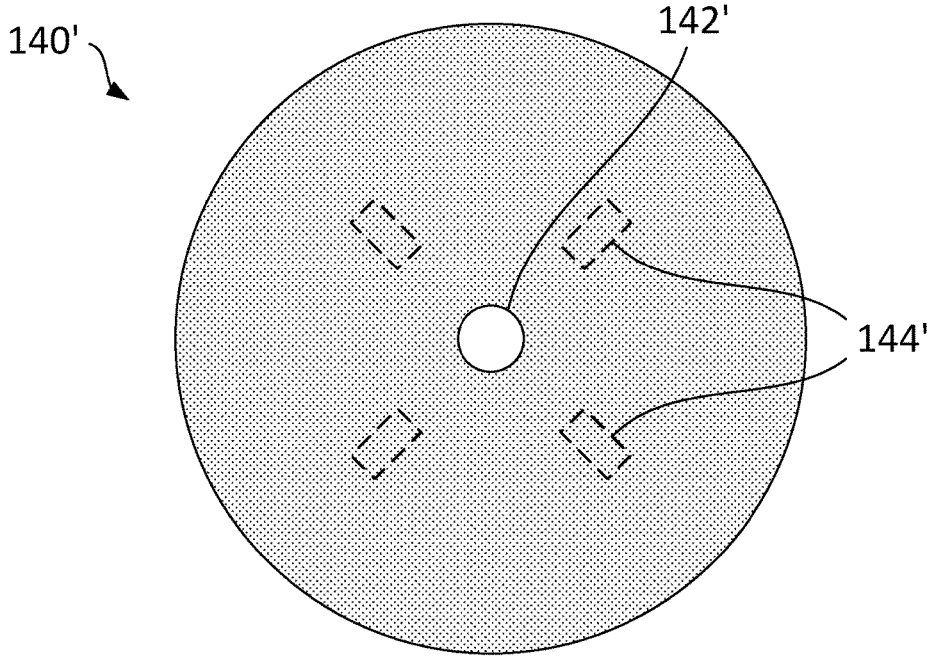
FIG. 1D shows a sectional view of the thermally insulated region of a second drinking vessel.

In the drinking vessel illustrated in FIGS. 1A and 1C a plurality of lower channels 142 are provided through the thermally insulating region 140 in the base of the drinking vessel. Alternatively, a single lower channel 142' may be provided through the thermally insulated region 140' for allowing liquid L to flow between the inner and outer liquid chambers 120, 130, as shown in FIG. 1D. The single lower channel 142' may be provided centrally through the thermally insulating region 140 in the base of the drinking vessel. The provision of a single lower channel 142' may enhance convection control, in the case that the drinking vessel 100 is not orientated vertically, e.g. when rested upon a surface that is not horizontal, in which case lower channels 142 at different levels may contribute differently to the convection. Again the thermally insulating region 140' is provided with one or more spacers 144' to space apart the thermally insulating region from the outer wall (or the outer wall may be provided with the one or more spacers).

Although described with the valve being controlled with a user-operable lever 151, it will be appreciated that alternative user-operable control of the valve may be provided.

Figure 2B:
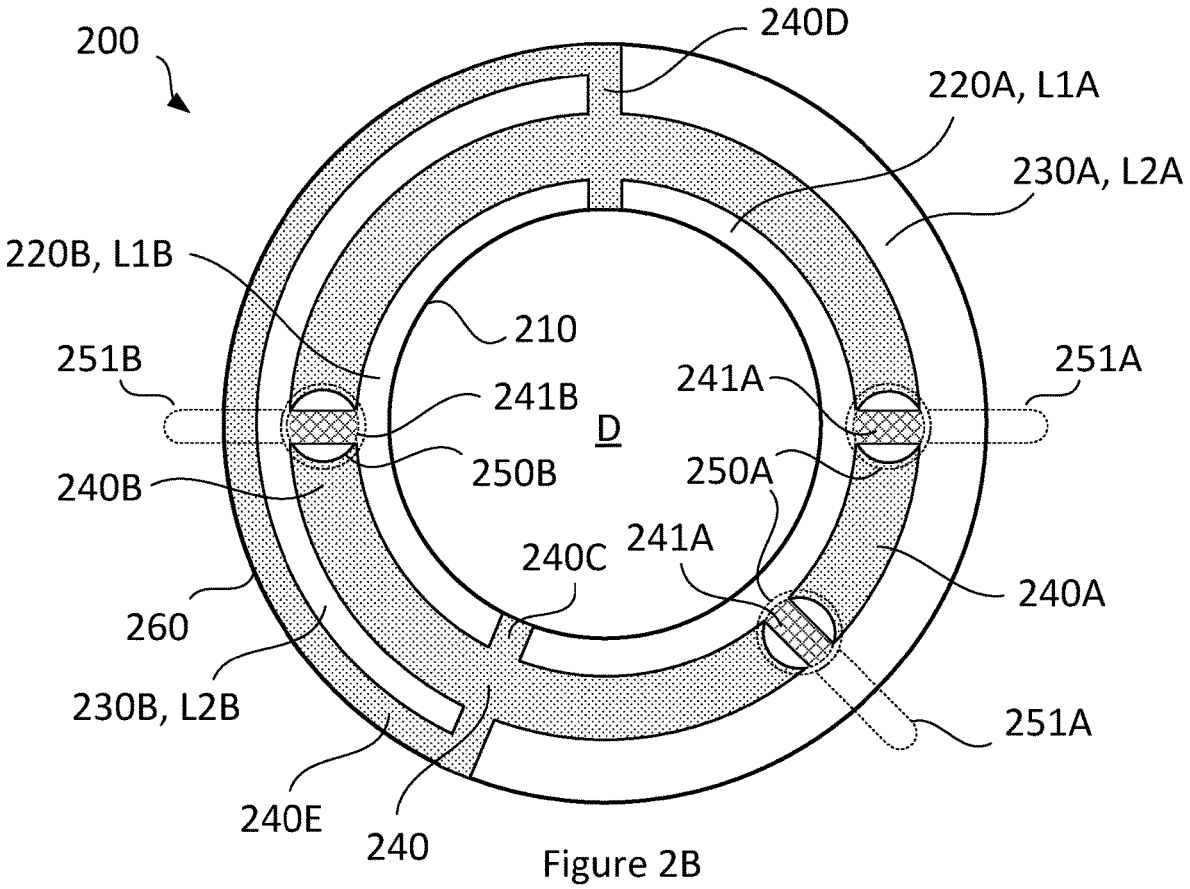
FIGS. 2A and 2B show vertical and horizontal sectional views of a third drinking vessel.
Figure 2A:
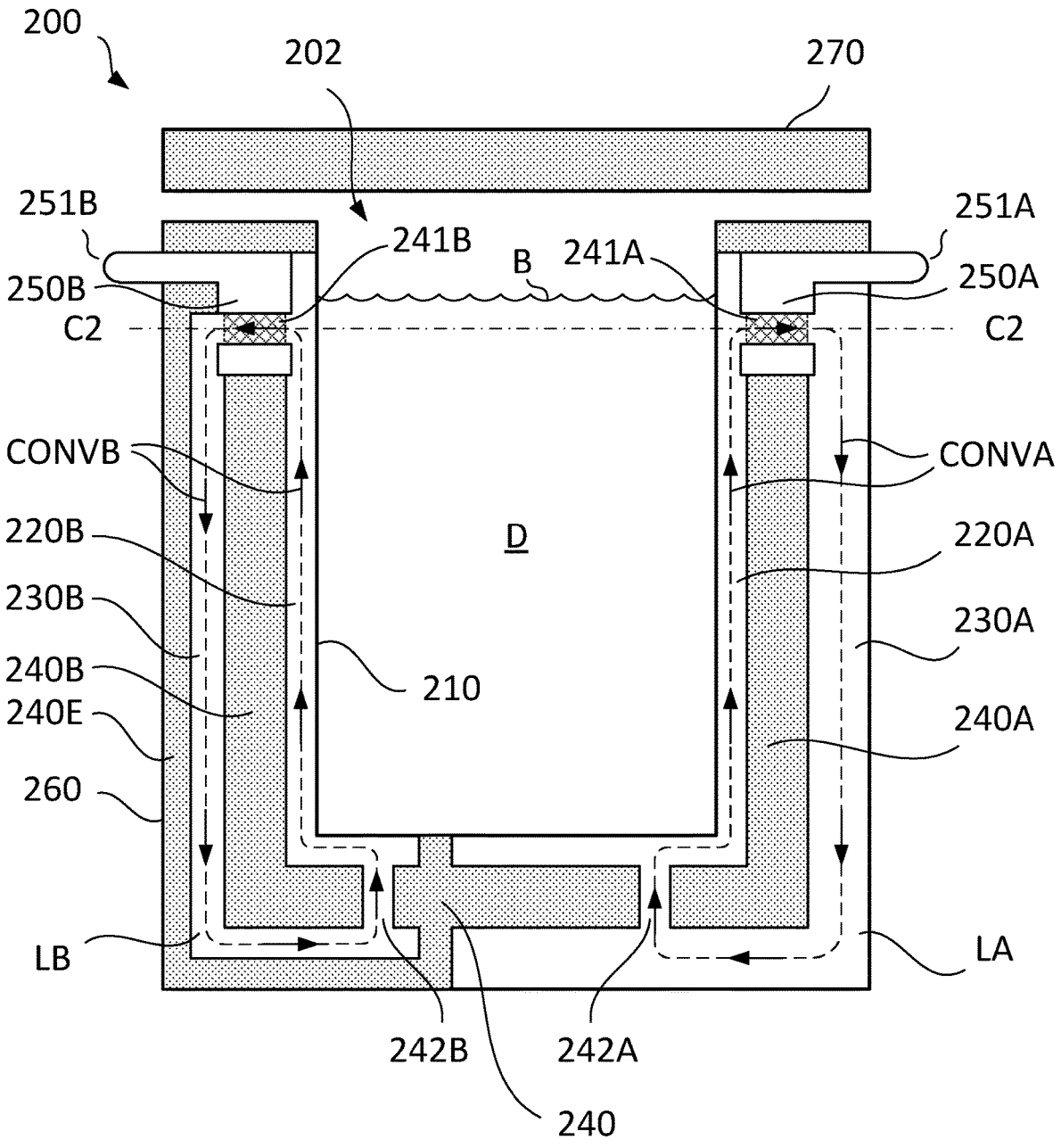

FIGS. 2A and 2B show sectional views through a second drinking vessel 200 respectively in vertical and horizontal planes (e.g. when its base is rested on a horizontal tabletop). FIG. 2B shows horizontal cross-section C2 through the drinking vessel 200 of FIG. 2A. The second drinking vessel 200 is generally similar to the first drinking vessel 100. In contrast to the first drinking vessel 100, in the circumferential direction, the second drinking vessel 200 has two inner liquid filled chambers 220A, 220B, two outer liquid filled chambers 230A, 230B, and a different arrangement of the thermally insulating region 240. The thermally insulating region 240 has: a first portion 240A providing a thermally insulating layer between the first inner liquid filled chamber 220A and the first outer liquid filled chamber 230A; a second portion 240B providing a thermally insulating layer between the second inner liquid filled chamber 220B and the second outer liquid filled chamber 230B; and further portions 240C, 240D respectively providing a thermally insulating partition between the inner liquid filled chambers and the outer liquid filled chambers.

The volume of liquid L1A, L2A in the first inner and outer liquid filled chambers 220A, 230A may be different from the volume of liquid L1B, L2B in the second inner and outer liquid filled chambers 220B, 230B. The first and second inner liquid filled chambers 220A, 220B may have different volumes L1A, L1B. The first and second outer liquid filled chambers 230A, 230B may have different volumes L2A, L2B. The first inner and outer liquid filled chambers 220A, 230A may have different volumes L1A, L2A. The second inner and outer liquid filled chambers 220B, 230B may have different volumes L1B, L2B.

Upper channels 241A (one or more, e.g. two as shown) extend through the first portion 240A of the thermal insulating region 240, between the first inner and outer liquid filled chambers 220A, 230A, near the opening 202 (near the top of the wall of the drinking vessel). The upper channels 241A may be opened and closed by opening and closing their respective valves 250A (e.g. operated by the user with levers 251A that are accessible on the outside of drinking vessel 200, e.g. accessible at a side surface of the drinking vessel). A first lower channel 242A (or a plurality of lower channels) extends through the thermally insulating region 240, between the first inner and outer liquid filled chambers 220A, 230A, in the base portion of the drinking vessel 200.

An upper channel 241B extends through the second portion 240B of the thermal insulating region 240, between the second inner and outer liquid filled chambers 220B, 230B, near the opening 202 (near the top of the wall of the drinking vessel). The upper channel 241B may be opened and closed by opening and closing a valve 250B (e.g. operated by the user with lever 251B that is accessible on the outside of drinking vessel 200). A second lower channel 242B (or a plurality of lower channels) extends through the thermally insulating region 240, between the second inner and outer liquid filled chambers 220B, 230B, in the base portion of the drinking vessel 200.

In the illustrated drinking vessel 200, the outer wall 260 of the drinking vessel extends around the outside of both the first and second outer liquid chambers 230A, 230B. The drinking vessel 200 is provided with a further thermally insulated region 240E extending and providing thermal insulation between the outer liquid chamber 230B and the outer wall 260 of the vessel 200. In the illustrated drinking vessel 200, no thermally insulated region is located between the first outer liquid chamber 230A and the outer wall 260 of the vessel 200.

The vessel may be provided with a removable lid 270.

In use, the drinking vessel 200 may initially be set with all valves 250A, 250B open, enabling heat from a hot beverage B to be dissipated to liquid LA, LB in all of the inner and outer liquid filled chambers 220A, 220B, 230A, 230B. As liquid LA, LB in each of the inner liquid filled chambers 220A, 220B is warmed by the heat of the beverage in the drink chamber D, convection currents CONVA, CONVB arise in the respective liquids. The liquids LA, LB in the inner liquid filled chambers 220A, 220B rise by convection, and respectively flow through upper channels 241A, 241B into the upper regions of the outer liquid filled chambers 230A, 230B. Cooler liquid LA, LB from the lower regions of the outer liquid filled chambers 230A, 230B flows through lower channels 242A, 242B respectively into the inner liquid filled chambers 220A, 220B, where it comes into thermal contact with the beverage in the drink chamber D through the inner surface 210 of the vessel. The transfer of warmed first liquid LA from the first inner liquid filled chamber 220A to the first outer liquid filled chamber 230A enables the transfer of heat from the beverage to the exterior of the drinking vessel for dissipation of heat to the external environment, to enable an over-temperature drink to cool rapidly to a drinkable temperature.

In use, the drinking vessel 200 may alternatively be set with the first valves 250A open and second valve 250B closed, enabling heat from a hot beverage to be dissipated to liquid LA in the first outer liquid filled chamber 230A by convection current CONVA, and from the outer liquid filled chamber 230A to the exterior of the drinking vessel 200 (e.g. to the external environment). This arrangement enables less rapid cooling of the beverage than when the second valve 250B is also open.

In use, the drinking vessel 200 may alternatively be set with first valves 250A closed and second valve 250B open, enabling heat from a hot beverage to be transferred to liquid LB in the second outer liquid filled chamber 230B. After an initial cooling phase, in which heat is transferred rapidly from the beverage in the drink chamber D to the second liquid LB, the arrangement enables slower subsequent cooling, because the liquid in the second outer liquid filled chamber 230B is thermally insulated by the further thermally insulated region 240E, which provides thermal insulation between the second outer liquid chamber 230B and the outer wall of the vessel 260.

Whether to thermally couple heat from the drink to one or to multiple bodies of liquid within the outer liquid filled chambers 230A, 230B, may be chosen dependent upon the amount of heat transfer required, with thermal coupling to all outer liquid chambers enabling larger and more rapid heat transfer than thermal coupling to only a single outer liquid chamber. As the different inner and outer liquid chambers may have different volumes, and may or may not themselves be thermally insulated from the outer wall of the vessel, the selection of different convection arrangements enables different levels of cooling performance to be selected.

Once the drink has reached a drinkable temperature, the drinking vessel 200 can be set with all valves 250A, 250B closed, preventing the transfer of heat by convection between any inner and outer liquid filled chambers, to better thermally insulate the beverage, and reduce the rate at which it cools further, so maintaining the drink at a palatable temperature for longer.

Figure 3A:
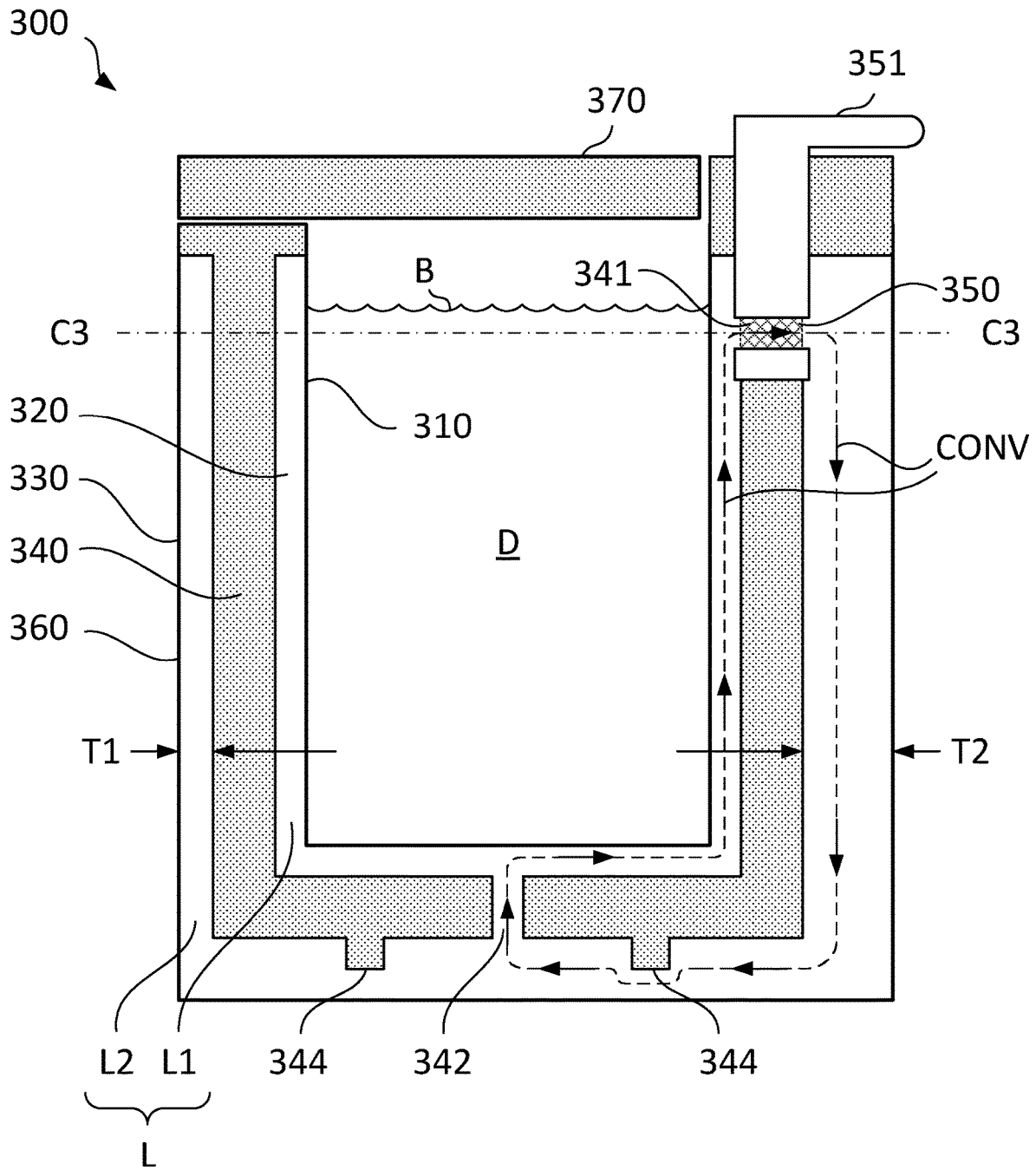
FIGS. 3A and 3B show vertical and horizontal sectional views of a fourth dinking vessel.
Figure 3B:
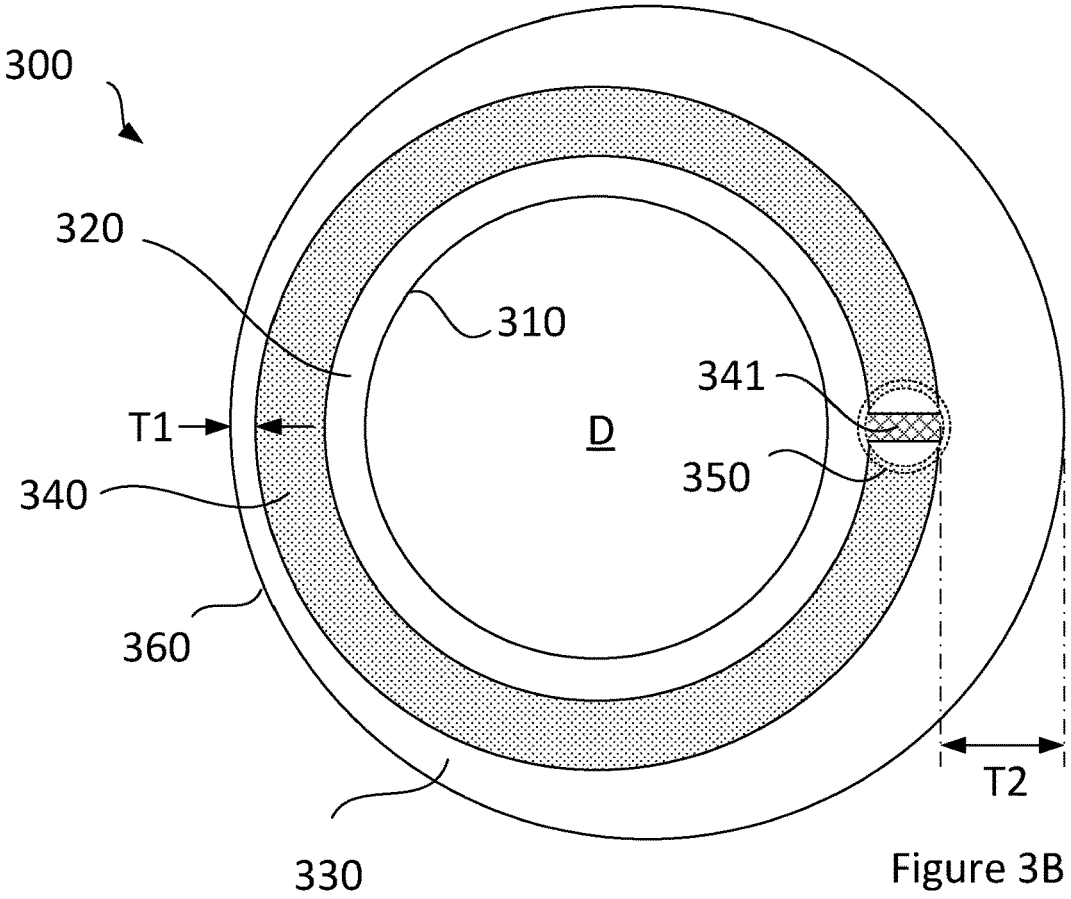

FIGS. 3A and 3B illustrate a further drinking vessel 300, similar to the drinking vessel 100 of FIGS. 1A to 1C, with one (or more) lower channels 342 and a plurality (or one) of spacers 344 to space apart the thermally insulating region from the outer wall (or the outer wall may be provided with the one or more spacers). FIG. 3B shows horizontal cross-section C3 through the drinking vessel 300 of FIG. 3A.

In the drinking vessel 100 of FIGS. 1A to 1C, the thermally insulated region 140 and the outer wall 160 are both generally symmetrically located (e.g. coaxially located) with respect to the drink chamber D, providing an outer liquid filled chamber 130 of substantially uniform radial thickness T. In contrast, in the drinking vessel 300 of FIGS. 3A and 3B, the outer wall 360 is offset with respect to the thermally insulated region 340 (e.g. and offset with respect to the drink chamber D), providing an outer liquid filled chamber 330 with a thickness T2 adjacent the outer wall that is greater on the side of the drink chamber D that is proximate the valve 350 than the thickness T1 on the remote side of the drink chamber. Offsetting the outer wall 360 with respect to the thermally insulated region 340 may enhance liquid flow though the upper channel 341 (i.e. through the valve 350), or facilitate the provision of a larger valve, by spacing the outer wall further from the valve and may enhance convection flow through the inner and outer liquid filled chambers 320, 330 adjacent the valve.

In the drinking vessels 100, 200 of FIGS. 1A and 2A, the user operable valve 150, 250 is accessible at a side surface of the drinking vessel. Alternatively, the control for the user operable valve 350, for controlling circulation of liquid between the inner liquid filled chamber and the outer liquid filled chamber by a convection current, may be accessible at the top of the drinking vessel, e.g. drinking vessel 300 has lever 351 accessible at the top, as shown in FIG. 3A.

Figure 4:
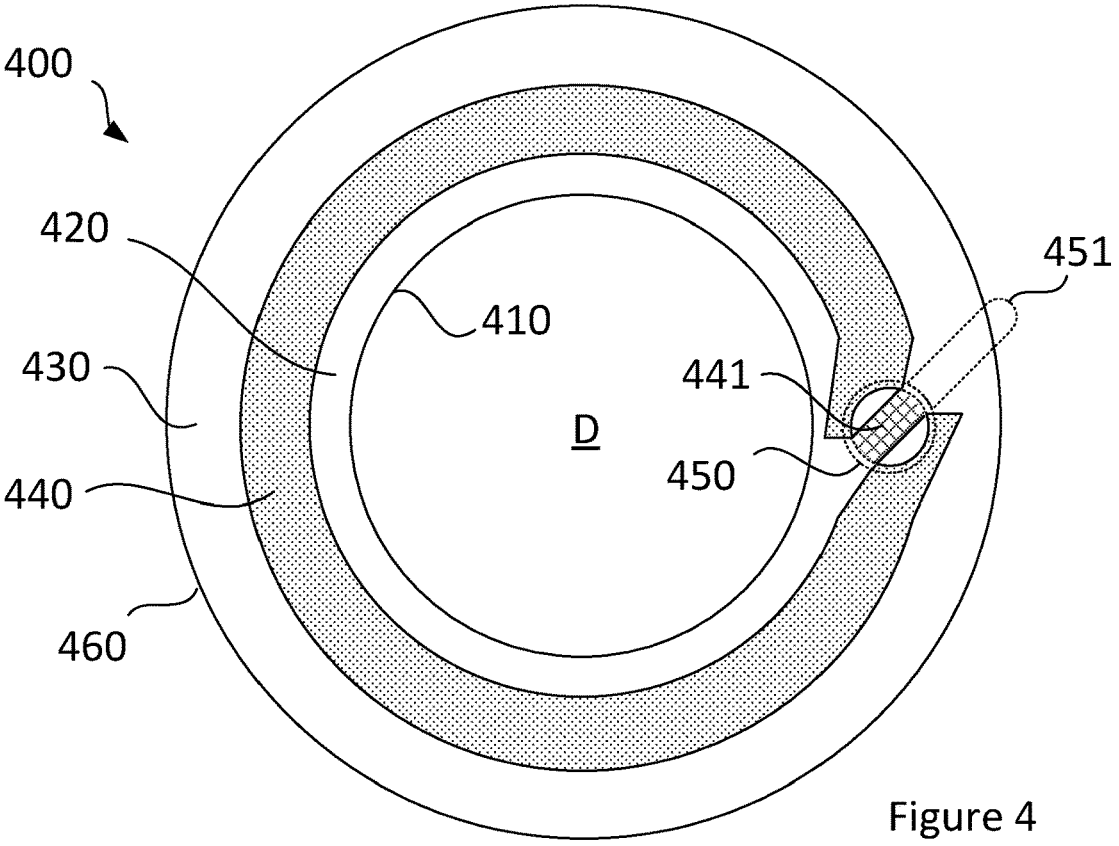
FIG. 4 shows a horizontal sectional view of a fifth drinking vessel.

In the drinking vessels of earlier figures, the upper channels 141, 241, 341 are illustrated extending outwardly through the thermally insulating region 140 generally perpendicularly to the drink chamber D (e.g. radially). Alternatively, the upper channel 441 may be angled away from being perpendicular to the inner wall 410 of the drink chamber D (e.g. angled away by at least 30°, e.g. 45°), as shown in FIG. 4. Being angled away from the perpendicular to inner wall 410 of the drink chamber and the outer wall 460 may enhance liquid flow though the upper channel 441 (i.e. through the valve 450), or facilitate the provision of a larger valve, by spacing the inner wall of the drink chamber and the outer wall further from the upper channel.

In the drinking vessels of earlier figures, the side wall of the thermally insulating region has had a generally uniform thickness between generally cylindrical inner and outer surfaces. Alternatively, either or both of the inner and outer surfaces of the side wall of the thermally insulating region may be provided with ribs extending generally up the height of the insulating region (i.e. extending vertically, when the base of the drinking vessel is horizontal).

Figure 5A:
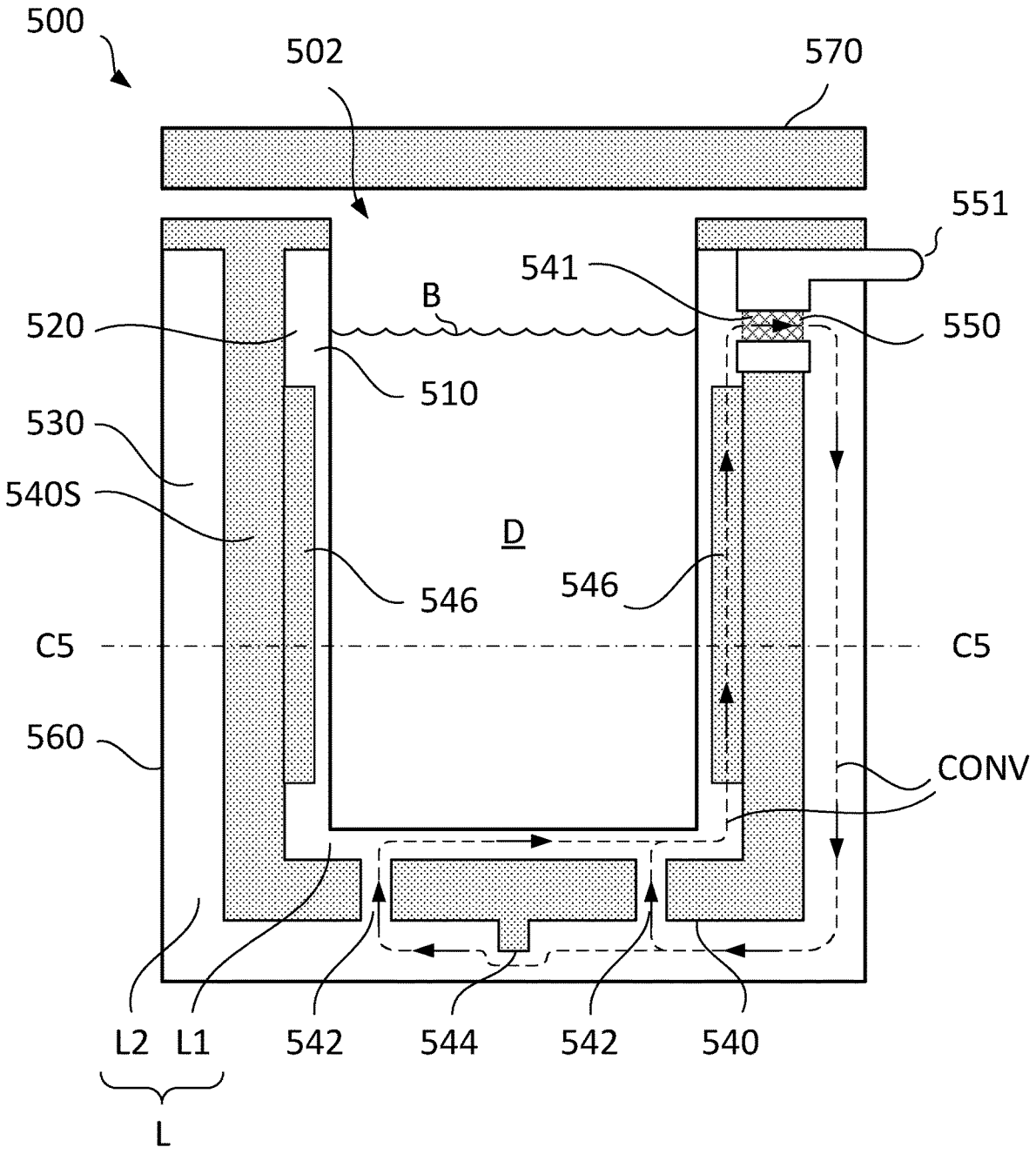
FIGS. 5A and 5B show vertical and horizontal sectional views of a sixth dinking vessel.
Figure 5B:
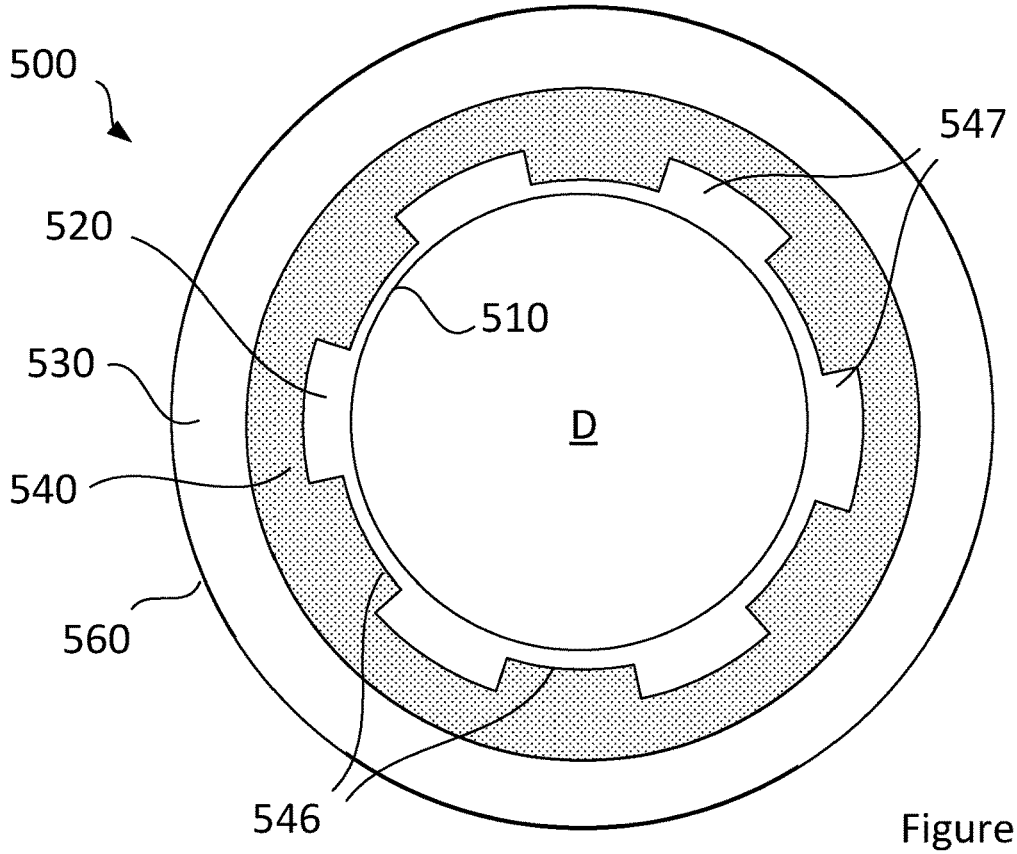

FIGS. 5A and 5B show a drinking vessel 500 with inwardly projecting ribs 546 extending inwardly from the inner surface of the side wall 540S of the thermally insulating region 540, which extend along (at least part of, e.g. at least 50% of) the height of the drinking vessel. The ribs 546 extend into the inner liquid filled chamber 520, reducing its volume, whilst maintaining intervening chamber channels 547 for liquid flow between the ribs. The chamber channels 547, extending generally along the height of the drinking vessel provide a lower hydraulic resistance for liquid L to flow between the lower channel(s) 542 and upper channel(s) 541 than for an inner liquid filled chamber with the same volume, but that is evenly distributed around the circumference of the drink chamber D (e.g. same radial thickness of the inner liquid filled chamber). The chamber channels 547 may be evenly spaced apart around the drink chamber D (e.g. providing a periodically repeating pattern of chamber channels and intervening ribs 546). Perpendicular to the inner wall 510, forming the drink chamber D, the chamber channels 547 may have a thickness of at least 4 mm. By enabling a reduced volume of liquid in the inner liquid filled chamber 520, whilst maintaining convection flow performance, the provision of the inwardly projecting ribs 546 (or corrugations discussed below) provides a reduced thermal mass of liquid in the inner liquid filled chamber, reducing the initial cooling of a heated beverage B received into the drink chamber D, e.g. when the valve 550 is closed.

The illustrated inwardly projecting ribs 546 are spaced apart from the inner wall 510 forming the drink chamber D. However, alternatively, the inwardly projecting ribs may extend to the inner wall forming the drink chamber, e.g. the thermally insulating region may be mounted onto the inner wall, which may support the thermally insulating region against displacement in use, and may enable the use of a thermally insulating region formed from a more flexible or more lightweight material than would be required for a thermally insulating region in which the side wall is self-supporting.

As shown in FIG. 5A, the ribs 546 may extend up only part of the height of the inner surface of the thermally insulating region 540, with a region above from which the ribs are absent (e.g. a region that includes the level at which the valve 550 is provided), to facilitate circumferential movement of the liquid L towards the upper channel(s) 541. Similarly, there may be a region below the ribs from which they are absent, to facilitate circumferential movement of the liquid L from the lower channel(s) 542. FIG. 5B shows horizontal cross-section C5 through the drinking vessel 500 of FIG. 5A.

Figure 5C:
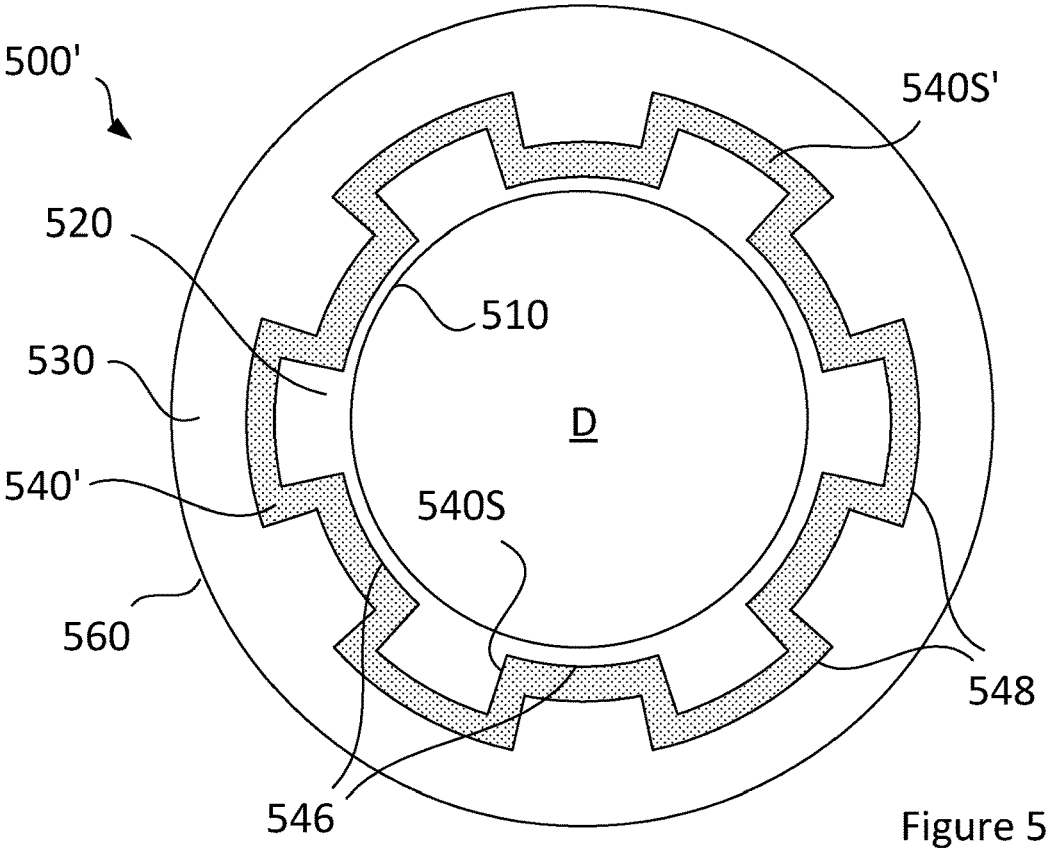
FIG. 5C shows a horizontal sectional view of a seventh drinking vessel.

Similarly to FIG. 5B, as shown in FIG. 5C, a drinking vessel 500' may additionally (or alternatively) be provided with outwardly projecting ribs 548 extending outwardly from the outer surface of the side wall of the thermally insulating region 540', which extend along (at least part of, e.g. at least 50% of) the height of the drinking vessel.

The thermally insulating region 540' may have a generally uniform thickness that varies in shape around the circumference of its side wall, forming a corrugated wall (a series of generally parallel ridges and grooves, generally extending up the height of the drinking vessel 500'). The corrugated side wall may have a generally uniform thickness. A corrugated side wall may provide enhanced rigidity and strength to the thermally insulating region than a cylindrical side wall, and may be less complex to manufacture than a side wall with only inwardly or outwardly projecting ribs.

The provision of a corrugated side wall of the thermally insulating region may enable both a reduced volume of liquid in the inner liquid filled chamber and an increased volume of liquid in the corresponding outer liquid filled chamber, both reducing the initial cooling of a received hot beverage and enhancing the amount of cooling available by opening the valve to permit convection flow in the liquid L.

Although in the earlier figures, the user operable valve has been illustrated as a barrel valve (e.g. a trunnion ball valve), alternative control valves may be used, for example a gate valve, a globe valve, or a slideable plug. Alternatively, an externally mounted moveable magnet may be provided to operate a magnetically operated flap valve.

The skilled person will appreciate that features illustrated in different figures may be combined, for example combining two or more of the features of: a plurality of inner and outer liquid filled chambers; a thermally insulated region extending and providing thermal insulation between an outer liquid chamber and the outer wall of the drinking vessel; an outer wall that is offset with respect to the thermally insulated region; an upper channel angled away from the perpendicular to inner wall of the drink chamber and the outer wall; ribs extending inwardly from the inner surface of the side wall of the thermally insulating region; ribs extending outwardly from the outer surface of the side wall of the thermally insulating region; and a thermally insulating region having a corrugated wall.

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A drinking vessel having a drink chamber with an opening for receiving a drinking liquid, wherein the drink chamber is defined by a drink chamber wall, wherein the drinking vessel has an inner liquid filled chamber for receiving heat from a drink liquid in the drink chamber through the drink chamber wall, in use, the drinking vessel has an intermediary thermally insulating layer and an outer liquid filled chamber that is thermally insulated from the inner liquid filled chamber by the intermediary thermally insulating layer, the drinking vessel has an upper channel and a lower channel for providing fluid communication through the intermediary thermally insulating layer between the inner liquid filled chamber and the outer liquid filled chamber, wherein the upper channel is closer to the opening of the drink chamber than the lower channel, and the drinking vessel has a user operable valve for opening and closing at least one of the upper channel and the lower channel for controlling circulation of liquid in a convective loop through the upper channel and the lower channel between the inner liquid filled chamber and the outer liquid filled chamber by a convection current.

2. The drinking vessel of claim 1, wherein the drinking vessel has a base portion and a side wall, and the lower channel is provided through the intermediary thermally insulating layer in the base portion.

3. The drinking vessel of claim 1, wherein the drinking vessel has a base portion and a side wall, and the upper channel is provided through the intermediary thermally insulating layer in the side wall proximate the opening.

4. The drinking vessel of claim 1, wherein the total heat capacity of the inner liquid filled chamber and the outer liquid filled chamber is at least 20% of the heat capacity of water in the drink chamber, when the drink chamber is 80% full.

5. The drinking vessel of claim 1, wherein the total heat capacity of the inner liquid filled chamber and the outer liquid filled chamber is at least 30% of the heat capacity of water in the drink chamber, when the drink chamber is 80% full.

6. The drinking vessel of claim 1, wherein the total heat capacity of the inner liquid filled chamber and the outer liquid filled chamber is at least 40% of the heat capacity of water in the drink chamber, when the drink chamber is 80% full.

7. The drinking vessel of claim 1, wherein the volume of the outer liquid filled chamber is greater than the volume of the inner liquid filled chamber.

8. The drinking vessel of claim 1, comprising a plurality of inner liquid filled chambers and a plurality of outer liquid filled chambers.

9. The drinking vessel of claim 8, wherein a first upper channel and a first lower channel provide fluid communication through the intermediary thermally insulating layer between a first inner liquid filled chamber of the plurality of inner liquid filled chambers and a first outer liquid filled chamber of the plurality of outer liquid filled chambers, with a first user operable valve for opening and closing at least one of the first upper channel and the first lower channel, and a second upper channel and a second lower channel provide fluid communication through the intermediary thermally insulating layer between a second inner of the plurality of inner liquid filled chambers and a second outer liquid filed chamber liquid filled chamber of the plurality of outer liquid filled chambers, with a second user operable valve for opening and closing at least one of the second upper channel and the second lower channel.

10. The drinking vessel of claim 8, wherein the plurality of inner liquid filled chambers comprises inner liquid filled chambers having different volumes.

11. The drinking vessel of claim 8, wherein the plurality of outer liquid filled chambers comprises outer liquid filled chambers having different volumes.

12. The drinking vessel of claim 1, wherein the drinking vessel has an outer wall and an external thermally insulating layer extending between an outer liquid filled chamber and the outer wall.

13. The drinking vessel of claim 1, wherein the inner liquid filled chamber and the outer liquid filled chamber contain water.

14. The drinking vessel of claim 1, wherein the user operable valve is provided in the upper channel, and the upper channel is angled away from the perpendicular to an inner wall of the drink chamber, being angled away from being perpendicular to the inner wall of the drink chamber by at least 30°.

15. The drinking vessel of claim 1, wherein the intermediary thermally insulating layer has a side wall that is provided with inwardly projecting ribs.

16. The drinking vessel of claim 1, wherein the intermediary thermally insulating layer is provided with a side wall with outwardly projecting ribs.

17. The drinking vessel of claim 1, wherein the intermediary thermally insulating layer has a corrugated side wall with a shape that varies around the circumference of the side wall.

18. The drinking vessel of claim 1, wherein the outer liquid filled chamber has a thickness adjacent an outer wall that is greater on the side of the drink chamber that is proximate the user operable valve than the thickness on the side of the drink chamber that is remote from the user operable valve.

* * * * *